United States Patent [19]

Graf

[11] 3,946,950

[45] Mar. 30, 1976

[54] MATERIAL REDUCER

[75] Inventor: Carl R. Graf, Whitehall, Pa.

[73] Assignee: Pennsylvania Crusher Corporation, Broomall, Pa.

[22] Filed: May 16, 1973

[21] Appl. No.: 361,002

Related U.S. Application Data

[63] Continuation-in-part of Ser. Nos. 185,760, Oct. 1, 1971, abandoned, and Ser. No. 267,915, June 30, 1972, abandoned.

[52] U.S. Cl. ..... 241/18; 241/27; 241/55; 241/189 R

[51] Int. Cl.[2] ..... B02C 13/04

[58] Field of Search ..... 241/55, 56, 18, 19, 27, 241/186 R, 189 R, 82, 79.1, 274, 275, 186.3

[56] References Cited

UNITED STATES PATENTS

| | | | |
|---|---|---|---|
| 1,047,370 | 12/1912 | Bergquist | 241/27 UX |
| 1,384,821 | 7/1921 | Blum | 241/189 R X |
| 1,469,877 | 10/1923 | Blum | 241/189 R |
| 1,959,465 | 5/1934 | Dryfoos | 241/186.3 |
| 2,144,384 | 1/1939 | Mikan | 241/189 R X |
| 2,669,271 | 2/1954 | Treckmann | 241/55 |
| 2,735,469 | 2/1956 | West | 241/55 |
| 2,931,581 | 4/1960 | Lykken | 241/189 R X |
| 3,442,458 | 5/1969 | Meyer | 241/82 |
| 3,612,415 | 10/1971 | Merges | 241/82 X |

FOREIGN PATENTS OR APPLICATIONS

| | | | |
|---|---|---|---|
| 77,148 | 2/1954 | Denmark | 241/55 |
| 552,971 | 5/1943 | United Kingdom | 51/189 |

*Primary Examiner*—Donald G. Kelly
*Attorney, Agent, or Firm*—Pollock, VandeSande & Priddy

[57] ABSTRACT

A material reducer for coal, lignite, ore, stone, rock, oil shale and the like which employs rotary hammers, bars or the like not only to crush the material but also to propel the crushed material upwardly along a confined or partially confined path which discharges for example onto an output conveyor or directly to a screen or other processing equipment. The feed-in or input end of the crusher can be at a level sufficiently low to be supplied by the newer more mobile loading units such as front-end loaders, over-the-head loaders, and others. The center of gravity can also be substantially lowered, providing more stability without the normal cumbersome frame and support structure. Crushers constructed in accordance with the invention can be made far lighter and more mobile than existing mobile crushers with the same capacity, and therefore provide a practical way of eliminating the use of trucks, with their attendant noise, dust and pollution, to haul uncrushed minerals from the bottom of a mine or quarry to a stationary crusher at the surface.

10 Claims, 14 Drawing Figures

FIG. 3
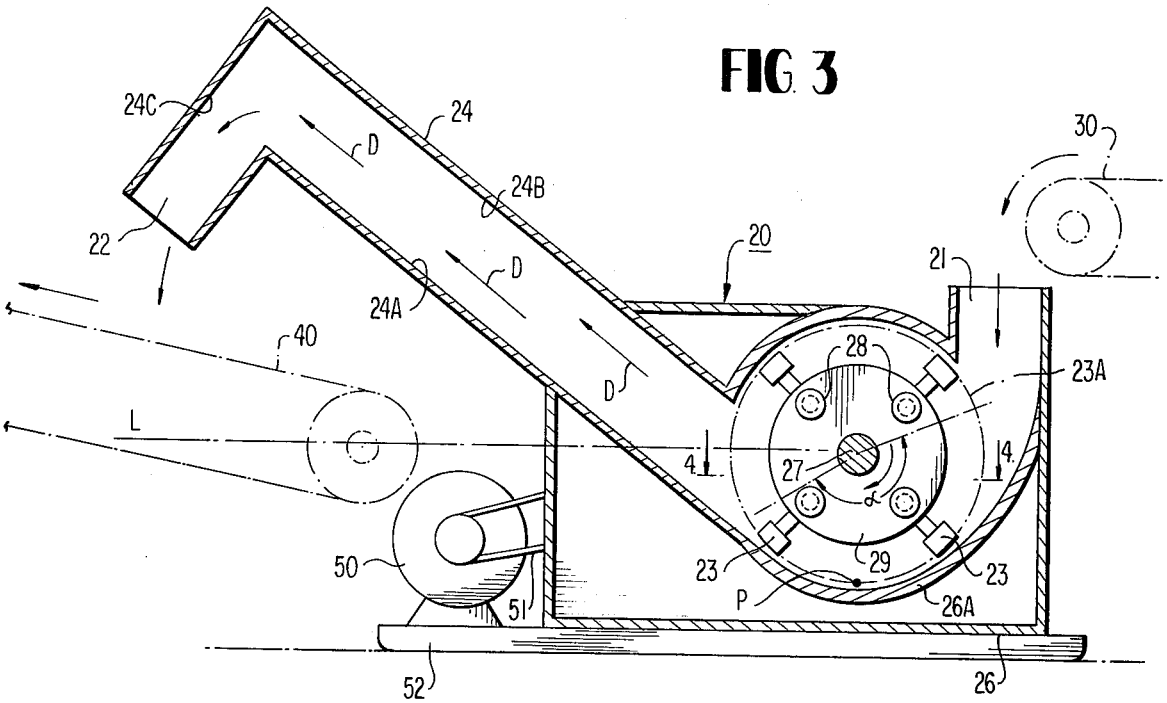
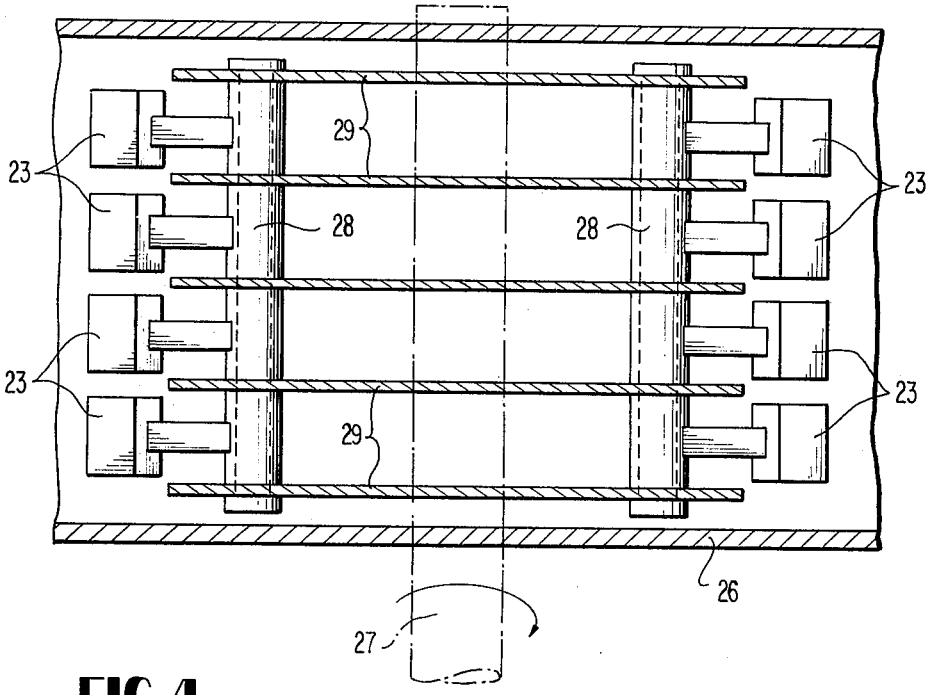
FIG. 4

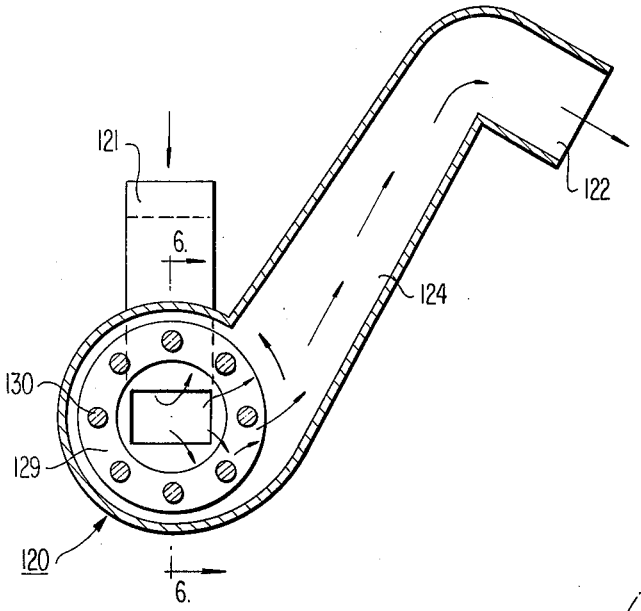
FIG. 5
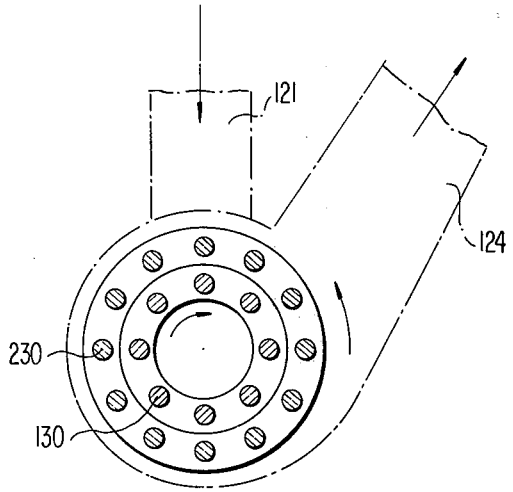
FIG. 7
FIG. 6
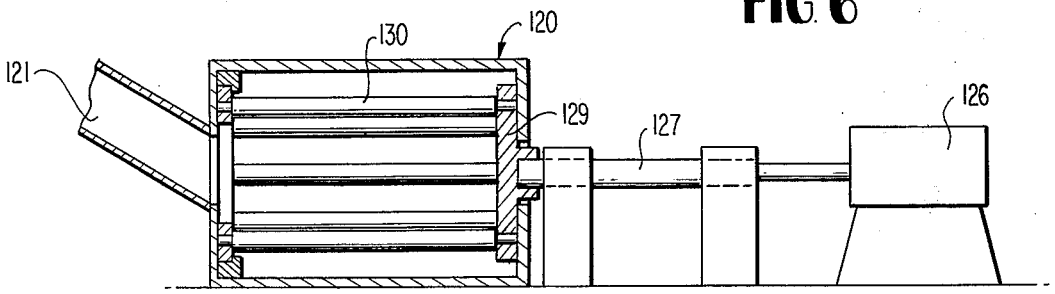

MATERIAL REDUCER

CROSS REFERENCE TO RELATED APPLICATIONS

This application is a continuation-in-part of my earlier filed copending U.S. patent applications, Ser. No. 185,760, filed Oct. 1, 1971, and Ser. No. 267,915, filed June 30, 1972, both now abandoned, the disclosures of which are hereby incorporated by reference.

BACKGROUND OF THE INVENTION

This invention relates to crusher apparatus and methods. These are especially useful for reducing ore, rock, stone, and the like. In mining or extraction, random size pieces of mineral material are produced, some too large to be carried out of the mine or quarry on conveyor belts of practical and economical width. Bucket or skiff conveyors have been tried, but have been expensive to build, operate and maintain.

Thus, motor trucks have been used to carry uncrushed minerals from the bottom of mines or quarries to a distant or upper surface for crushing. The trucks are often noisy polluters which consume much capital and operating expense, especially when the roadway is icy, wet or muddy.

For various reasons, including perhaps the desire to provide reversible hammer rotation and design symmetry, and/or perhaps due to inertia of thought in the art, the massive crushers most commonly used heretofore in the crushing of large chunks of heavy minerals have included a top inlet and bottom outlet. Positioning a conveyor belt below such a crusher to receive crushed material from the outlet involves elevating the crusher above ground on heavy supporting framework, or constructing a trench beneath it. This can raise the inlet to a difficult or prohibitive height for conventional mobile loaders or loading equipment, and/or makes the crusher considerably less mobile or less stable and more expensive to install.

In principle, mineral extraction costs can be reduced by crushing the large chunks to a convenient size in the quarry or at the mine face, and then carrying them to the surface by belt conveyors of practical size and width. However, under many circumstances, the above-described problems and the ponderosity and expense of available mobile crushers frustrate the use of this money-saving procedure.

OBJECTS OF THE INVENTION

It is a primary object of the present invention to provide a relatively simple and inexpensive crusher which makes it unnecessary to truck mineral materials from the bottom of a mine or quarry.

Another object of the invention is to provide a crusher machine which effectively performs the necessary functions of far heavier and more expensive mobile crushers heretofore used.

Still another object is to provide crushing apparatus which can be conveniently operated in a mine or quarry.

Yet another object is to provide a crusher which can be discharged directly to a conveyor, screen, or other transport and processing equipment and yet requires no high elevating framework or subjacent trench.

A still further object is to provide machinery for crushing mineral materials which can be discharged directly to a conveyor, screen, or the like and yet can be readily supported in a manner giving it good stability against tipping.

A further object is to provide crushing means which can be loaded directly by mobile loaders such as front-end or over-the-head loaders.

Another object is to provide crushing apparatus which can itself be readily constructed in a mobile form which is relatively stable against tipping, is relatively simple and light in weight, and yet provides a convenient discharge.

Another object is the provision of crusher machines having the aforesaid features which may be used to advantage in the crushing of mined coal or ore of a type or types not excessively hard, and particularly in the crushing of coal or limestone.

Yet another object is to provide a method of impact crushing mineral materials which can significantly reduce problems heretofore associated with the transport of mineral materials from the floor or face of a mine or quarry.

Upon consideration of the summary and the various embodiments of the invention described below, it will be apparent that the invention can be embodied in forms which attain some or all of the above objects. Moreover, additional objects will occur to those skilled in the art. In any event, the practice of the present invention offers various significant advantages.

SUMMARY OF THE INVENTION

The invention provides material reduction apparatus for mineral materials such as ore, rock, stone, oil shale, coal, lignite and the like. Such apparatus comprises a rotor having any suitable form of impact members mounted thereon, for instance, fixed or pivotable hammers or bars. These are arranged in spaced relationship about the rotor, and their peripheries define an impactor circle, of which there may be several.

The rotor is mounted for rotation in a housing having a curved, imperforate impact surface. By "imperforate", it is meant that the surface is regular or irregular, but is for the most part devoid of "through" holes; for instance, if the surface is in the form of a plate punched with holes, this plate will normally be backed up by a blind plate which closes off all or most of the holes. On the other hand, the impact surface may be provided by filling the bottom of an enlarged housing with crushed mineral material, such as the material which is crushed in said apparatus, until the level of said crushed material reaches a level slightly below but adjacent to said impactor circle.

The aforesaid impact surface defines the outer perimeter of a zone of rotor-feed material-impact surface inter-reaction subtending an arc in said impactor circle which includes the lowest point in said impactor circle and extends upwardly on either side of said point. In the case of a rotor having several circles of impact members, there may be several of such zones in which the zones themselves and/or the hammer circles may have different diameters or be physically separated from one another by members intermeshing with laterally adjacent impact members. However, in a preferred embodiment of the invention, the impact surface or surfaces are free of discontinuous components intermeshing with (or in the lateral space between) laterally adjacent pairs of impact members. "Discontinuous components" refers to a durable member or members providing a series of inward projections from the impact surface spaced peripherally about the impact surface and separated by gaps sufficiently large to momentarily catch, stop or reverse the direction of a significant proportion of the mineral material which enters the gaps and collides with the projections.

The apparatus includes an inlet duct for charging the material to the rotor housing. The inlet duct may open into the housing directly adjacent the zone of rotor-feed material-impact surface inter-reaction or at any other suitable location. For instance, the duct may open into the housing within the impactor circle or alongside it. Preferably, the inlet is open to the atmosphere, so that air may be drawn into the housing as the feed material enters, and the air and feed may be caused to follow a common path through the apparatus until after they have both entered an outlet channel or duct. Also, the inlet may be connected with or include, any suitable means for controlled feeding of material into the housing in a predetermined range of mass rate, e.g., as by using an input conveyor means, including without limitation vibrating pan feeders (which are preferred), apron conveyors, table feeders and (where the feed material is in relatively small pieces) a belt conveyor.

The apparatus also includes an outlet channel which at least partially encloses a reduced material departure path. This path generally corresponds to the trajectory imparted to the material at the downstream end of the interreaction zone. In a preferred embodiment, this channel is so constructed that material thrown into it can travel its entire length without significant stoppage for removal of larger pieces, and then be delivered to direction changing and energy absorbing means. Thus, in a preferred embodiment, upstream of the direction changing and energy absorbing means, the channel or duct is substantially devoid of means impeding the motion of the larger pieces thrown into the duct by the rotor.

The direction changing and energy absorbing means may be of any type, including a rock box, chain curtain, angled metal surface or the like. It is connected with or beyond the duct or channel operationally, if not physically, and is oriented in the material departure path in position for receiving all — or at least the larger — pieces thrown off by the rotor, for slowing such material by absorbing a major portion of the kinetic energy thereof, and for discharging such material from the channel or duct without recycling to that rotor which propelled the material to the direction changing and energy absorbing means. Such means may discharge the material which reaches it by causing it to descend either directly or through any suitable discharge means, preferably unobstructed, including a further duct, channel, or the like, to any suitable receiver. This may for instance be a vehicle, a conveyor, a screen, the inlet of an additional material reduction apparatus, or another transport or processing apparatus. In a preferred embodiment, the outlet channel and direction changing and energy absorbing means are arranged to convey the entire range of materials thrown off by the rotor to the direction changing and energy absorbing means, and from thence to a discharge outlet without separation of the pieces of differing particle size and without return of material from the direction changing and energy absorbing means to the rotor. This discharge outlet is most preferably at least partly and preferably completely at an elevation which is higher than the low point of the impactor circle and most preferably higher than the axis of rotation of the rotor.

Also, it should be apparent that when ready for use, the apparatus will be provided with means for rotating the rotor with the periphery of the rotor adjacent the impact surface moving in the direction of said outlet channel and with sufficient speed to throw reduced material up the outlet channel to said energy absorbing and direction changing means.

In accordance with the method aspects of the present invention, air and mineral feed are introduced into a housing through an inlet opened to the atmosphere. The air and mineral feed are caused to flow along a common path from said inlet to a rotor in said housing. The feed material is contacted with rotating impact members on said rotor and with an impact surface in a rotor-feed material-impact surface inter-reaction zone subtending an arc including and extending upwardly from either side of the lowest point on the circle described by the rotating impact members at their peripheries. Material crushed by said rotor and impact surface is thrown upwardly and outwardly from the rotor along an at least partially confined channel using the kinetic energy imparted thereto by said rotor, to a level above the axis of rotation of the rotor. While the crushed material is still in flight, at least the largest pieces of crushed material are impinged against an energy absorbing and direction changing means. Then the crushed material is caused to descend from said energy absorbing and direction means to discharge from the apparatus without further contact with said rotor.

With the aid of the drawings described below, a few illustrative embodiments of the apparatus and the method of the present invention will now be described. A person skilled in the art will readily recognize that other embodiments are possible, and that the invention is not limited to the embodiments shown.

BRIEF DESCRIPTION OF THE DRAWINGS

FIG. 3 is a side elevational view, partly in section, of one form of crushing machine according to the present invention.

FIG. 4 is a view looking down along the line 4—4 of FIG. 3.

FIG. 5 is a schematic illustration of an alternate form of crushing machine according to the present invention.

FIG. 6 is a view looking along the line 6—6 of FIG. 5.

DETAILED DESCRIPTION OF VARIOUS EMBODIMENTS

Figure 1:
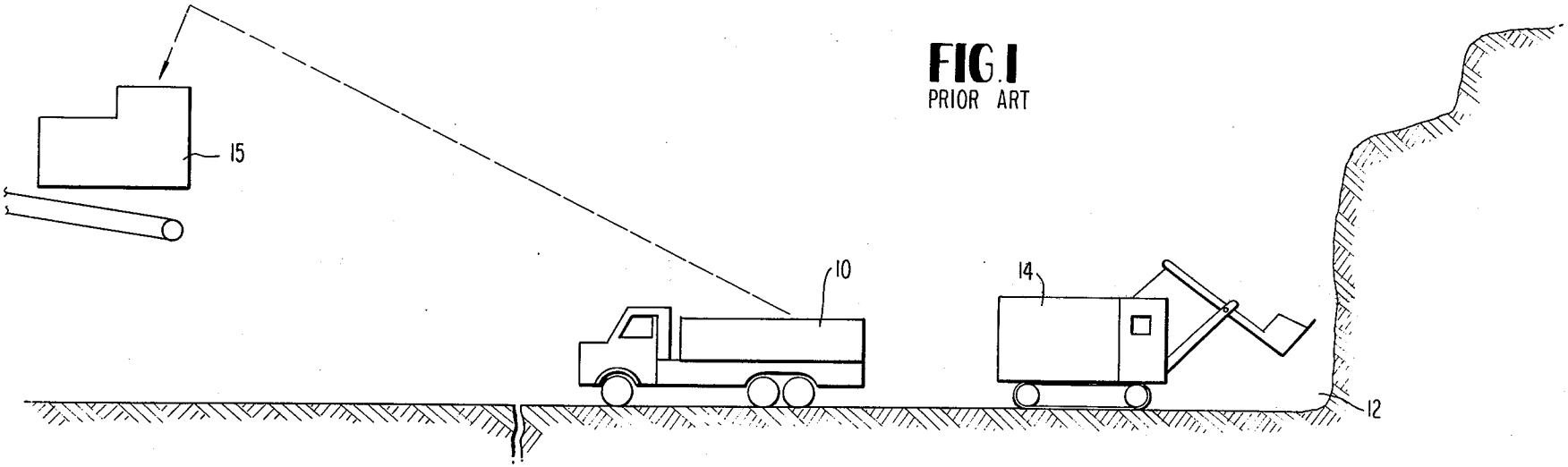
FIG. 1 PRIOR ART
FIG. 1 is a schematic illustration of a prior art system showing a truck being used at the floor of the mine or quarry for transporting the uncrushed ore or other material to an upper level where a stationary crushing machine is located.

Referring first to FIG. 1, there is illustrated a system commonly used heretofore in the mining of coal or ore for the quarrying of rock and stone. As there illustrated, trucks such as truck 10 on the floor or face 12 of the mine or quarry are loaded, as by steam shovel 14 or front-end or other loaders, and the uncrushed ore, rock or other material is generally carried by the trucks up ramps (not shown) to an upper level at which a stationary crushing machine 15 is installed. The problems of such a system have been discussed above.

Figure 2:
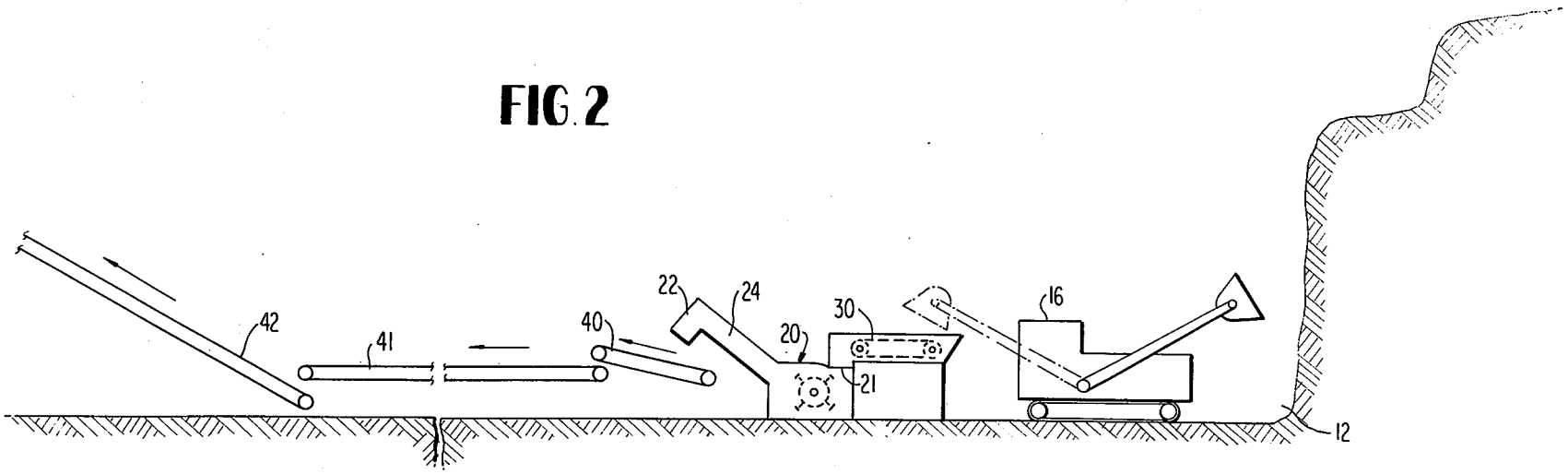
FIG. 2 is a schematic illustration of the manner in which a crusher machine according to the present invention may be employed on the floor or face of the mine or quarry to receive material supplied to it as by a loading machine and to project the crushed material upwardly and outwardly on to an output conveyor system or other processing equipment.

In FIG. 2, a crusher machine 20 according to the present invention is shown being loaded by an over-the-head loader 16. The crushing machine 20 rests on the floor of the mine or quarry and its input opening 21 is sufficiently low to accept the discharge from the loader. The loader may feed a conveyor 30 which carries material into crusher machine 20. This conveyor is not essential, but does permit controlling the mass feed rate to the crusher in a predetermined range or at least provides a more controlled feed than where the driver of loader 16 sporadically discharges complete loads directly into the crusher 20.

As seen in FIG. 2, the crushed output of the crushing machine is delivered at 22 at a level sufficiently high above ground to allow the crushed material to be dropped onto an output conveyor belt 40. A belt conveyor system such as 40, 41, 42 can now easily convey crushed material from the floor of the mine or quarry to an upper level.

The crusher 20 of FIG. 2 is disclosed in greater detail in FIGS. 3 and 4. Referring to the latter figures, said crusher has a housing 26 with rotor 27 mounted for rotation therein, in suitable bearings (not shown). A plurality of axially spaced rotor discs 29, carrying four hammer shafts 28, mounted at 90° intervals near the peripheries of the rotor discs 29, serve as pivotal mountings for four sets of impact membes, e.g., hammers 23, including four hammers in each set which are laterally (or axially) spaced relative to each other. The hammers could be mounted at random spacings about the discs, as long as weight balance about the rotor shaft is maintained. On rotation of the rotor means, including the shaft 27, rotor discs 29, and hammer shafts 28, the outer peripheries of the hammers 23 define an impactor or hammer circle 23A.

The housing 26 includes a curved, imperforate impact surface or member 26A. It defines the periphery of a zone of rotor-feed material-impact surface interreaction subtending an arc alpha ($\alpha$) in said impactor circle which includes the lowest point P in impactor circle 23A and extends upwardly on either side thereof.

While it is preferred that the impact surface be a fabricated member, preferably of highly wear resistant metal, the impact surface may be fabricated of other materials. For instance, it is contemplated that all or part of the fabricated impact surface 26A might be omitted, leaving the lower portion of the volume of housing 26 unoccupied. Upon the feeding of mineral material to the crusher machine, this open volume would become packed with crushed feed material, the level of which would rise in the housing to a level controlled by the rotation of the impact members and by the passage of additional feed material, and would thereby be formed into a curved impact surface.

The apparatus also includes an outlet channel which at least partially encloses a reduced material departure path generally corresponding to the trajectory imparted to the material at the downstream end of the inter-reaction zone and generally indicated by arrows D. This channel may be a duct of tubular or other shape enclosed partially or completely throughout its length and circumference. It will however be sufficiently enclosed to confine or at least partially confine the reduced material proceeding along departure path D. The surfaces of this duct 24 may be fabricated of metal, as shown, or may be provided with rock facings, e.g. rock boxes. In the preferred embodiment, the duct 24 has a lower surface or confining member 24A which comprises an upward, substantially tangential extension of the impact surface 26A. Also, in the preferred embodiment, the upper surface 24B terminates in a direction changing and energy absorbing means 24C, e.g. a rock box, chain curtain or fabricated metal impact surface, oriented in the material departure path D and positioned for slowing the material by absorbing a major portion of the kinetic energy thereof.

In this preferred embodiment, the energy absorbing and direction changing means 24C delivers all of the material received from the rotor means to a discharge outlet 22. The discharge outlet 22 is preferably unobstructed, so that the entire quantity of reduced material which strikes the energy absorbing and direction changing means may descend therefrom to any suitable receiver. When the discharge outlet is at least partly, or preferably completely, at an elevation which is higher than the low point P of impactor circle 23, and, most preferably, higher than the axis L of rotation of the rotor shaft 27, the output of crushed material from discharge outlet 22 may readily be fed directly onto a conveyor 40 without placing the conveyor in a trench under the crushing apparatus and/or without elevating the crushing apparatus on a high framework with the conveyor running underneath. This also makes it possible to mount the crusher on simple transport means, such as skids 52, crawler tracks, walking mechanism, wheels or the like so that it may be moved to any desired location in a mine, quarry or other facilities.

Certain advantages may accrue from properly engaging the base, e.g. skids 52, of the crusher with the ground surface, e.g. the bottom of a mine or quarry. This can be done for instance by interposing between the base and the ground surface a resilient sheet member which is free of attachment with the ground and which may be a durable porous synthetic and/or natural elastomer or blend thereof. The sheet will have a substantial thickness and resilience properties such that its upper and lower surfaces will deflect horizontally relative to one another in response to horizontal vibrations of the machine, while retaining frictional engagement with the machine and ground. The sheet may also undergo localized vertical deflection to accommodate irregularities in the ground surface. Thus, the sheet temporarily secures the machine at the desired location on the ground, permitting ready removal and at least partially reducing any tendency of the machine to creep. The machine may also be secured by a tether, if desired.

In view of the intended manner of operation of the apparatus, those skilled in the art will readily recognize from the foregoing description that the apparatus, when ready for use, will be provided with a means, such as electric motor 50 and drive belts 51, for rotating the rotor with the periphery of the rotor adjacent the impact surface 26A moving in the direction of outlet channel 24 and with sufficient speed to throw reduced material up outlet channel 24 to the energy absorbing and direction changing means 24C.

In FIG. 5, the uncrushed ore or other material is delivered through a feed-in chute 121 into the axial center of a cage mill 120 which includes a pair of spaced-apart discs 129 which support therebetween a plurality of rods or bars 130 which crush the ore material and throw it upwardly into the discharge chute 124 and out the nozzle 122. FIG. 6 is a view looking along section line 6—6 of FIG. 5 and shows how the cage is supported and driven rotationally by motor 126 and drive shafts 127.

FIG. 7 depicts a machine generally similar to that of FIGS. 5 and 6, except that the machine in FIG. 7 is a double counter-rotating cage mill. The material is fed through feed chute 121 into the axial center of the double cage and, after being crushed by the bars 130 and 230 of the counter-rotating cages, is thrown upwardly into the discharge conduit 124.

Figure 8:
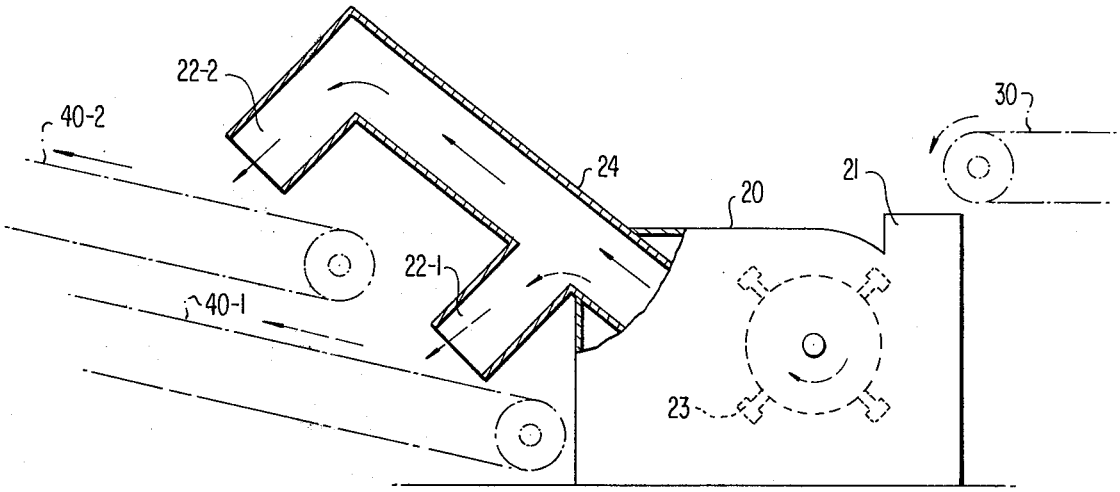
FIGS. 8–12 are schematic illustrations of still other forms of crushing machines embodying the present invention.

FIG. 8 illustrates a crusher machine generally similar to that of FIG. 3 but in FIG. 8 classification is obtained between the lighter fines and the heavier, larger particles. Discharge conduit 24 is provided with two or more discharge nozzles 22-1 and 22-2 so that the lighter fines discharge through the nearer nozzle 22-1 and the heavier particles discharge through the more remote nozzle 22-2. Two or more output conveyor belts 40-1 and 40-2 are provided for carrying away the fines and the larger particles, respectively.

The nozzles 22-1 and 22-2 may also be arranged to discharge both fine and heavier particles to the same conveyor belt. Heretofore, it has been conventional practice to charge a crusher from a scalping conveyor. Such conveyor discards fines and feeds larger particles into the inlet of the crusher. The output conveyor under the crusher passes first under the fines discharge outlet of the scalping conveyor, laying down a layer of fines thereon, and then passes under the discharge outlet of the crusher to receive the crushed product, including both large and small pieces. The previously placed layer of fines on the conveyor cushions the shock of the larger crushed pieces from the crusher, thus protecting and extending the life of the conveyor belt. In accordance with the present invention, it is not necessary to pass the conveyor belt under both a scalping conveyor and the bottom of the crusher. The nozzles 22-2 may be so oriented relative to their common output conveyor, so that nozzle 22-1 lays down a protective layer of fines on the belt upstream of nozzle 22-2. Thus, a scalping conveyor is no longer required.

In the preferred means and method of operation corresponding to the FIG. 8 embodiment, the rotor in the machine housing strikes, reduces and propels outwardly from the rotor a stream of solid material including lighter and heavier pieces. Means integral with and/or separate from the rotor are provided for generating a flow of air and for causing said stream and flow to enter discharge conduit 24 together. The latter defines a first confined path away from the rotatable means for receiving the stream and causing it to continue in motion in the direction in which it is impelled by the blows of the impact members, at least until it passes beyond discharge nozzle 22-1. Said nozzle defines a path diverging from the discharge conduit 24, for diverting at least a portion of the air flow and at least a portion of the lighter pieces in the stream together from the discharge conduit.

The desired air flow can be generated by the rotating impact members themselves and/or by suitable fans. The heaviest pieces thrown off by the rotor will maintain their velocity in the direction in which they are propelled for a relatively long distance. The lighter pieces, having a lower mass-to-surface ratio, tend to lose their forward velocity more rapidly. Moreover, the flow of air departing through nozzle 22-1 effects a more efficient capture and separation of the lighter pieces. In order to insure that there is a sufficient flow of air into nozzle 22-1, the nozzle 22-2 may be fitted with an air lock, or the nozzle 22-1 may have an air tight connection with a suitable receptacle in which suction is generated by a fan or other means.

Figure 9:
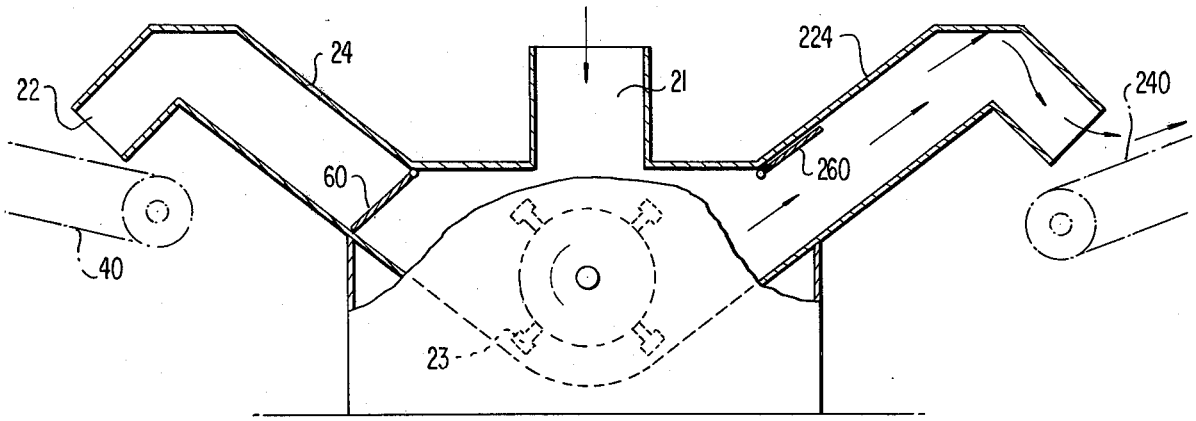

FIG. 9 illustrates a crusher machine generally similar to that of FIGS. 3 and 8 wherein the crusher is designed for reversible operation. Input chute 21 is centrally located above the axis of the rotor shaft of the hammers 23. Discharge conduits 24 and 224 are provided on both sides of the hammer circle. Output conveyors 40 and 240 are provided for receiving the discharge from the output conduits 24 and 224, respectively. Hinged gates 60 and 260 are provided, one on either side of the hammer circle, for preventing or for allowing material to be thrown into the discharge conduits. In FIG. 9, the hammers are indicated to be rotating in the counterclockwise direction, and gate 60 is shown in closed position while the gate 260 is in open position. This allows crushed material to be thrown by the hammers upwardly into the discharge conduit 224 but prevents any discharge of crushed material into conduit 24. It will be understood, of course, that when the hammers are rotated in the opposite or clockwise direction, the hinged gate 260 will be closed and the gate 60 will be open to allow the crushed material to be thrown into discharge conduit 24.

Figure 10:
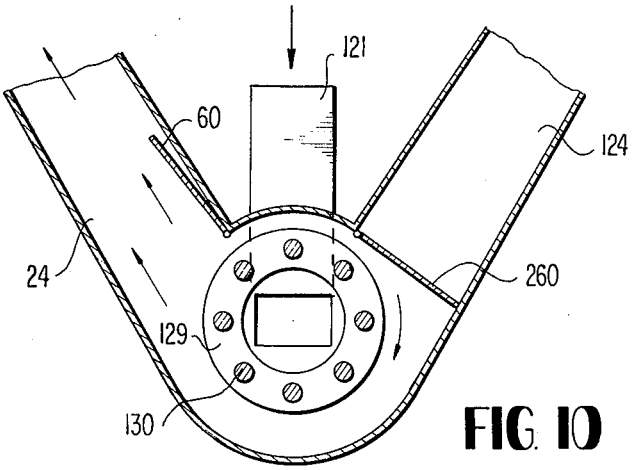

FIG. 10 illustrates a cage mill generally similar to that of FIG. 5 but of a reversible type. In FIG. 10, the cage mill is shown to be rotating in the clockwise direction and gate 60 is shown to be in open position while gate 260 is shown closed.

While not illustrated in the drawings, the double counter rotating cage mill of FIG. 7 could also be arranged for reversible operation by the provision of an additional discharge conduit, and a reversible drive for the cages.

Figure 11:
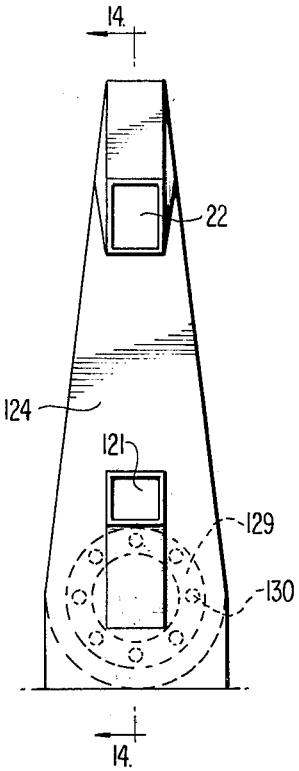
Figure 12:
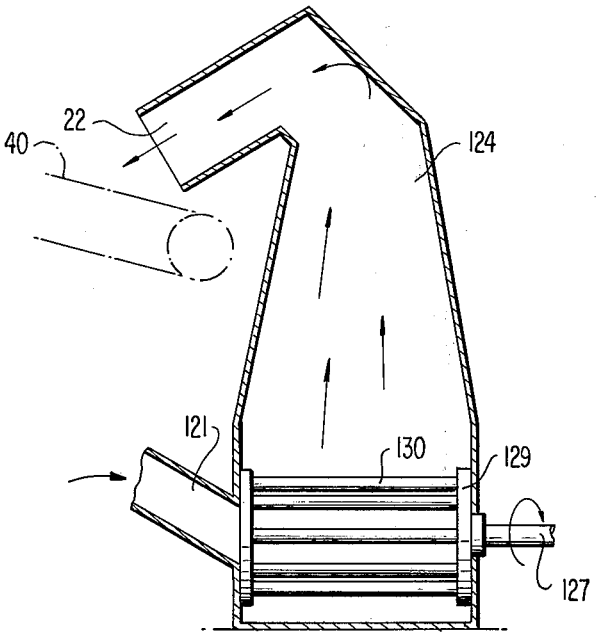

FIGS. 11 and 12 illustrate a cage mill crusher generally similar to that of FIGS. 5 and 6 but in which the discharge conduit 124 and output conveyor 40 are in the same plane as the input chute 121, rather than to one side thereof.

Figure 13:
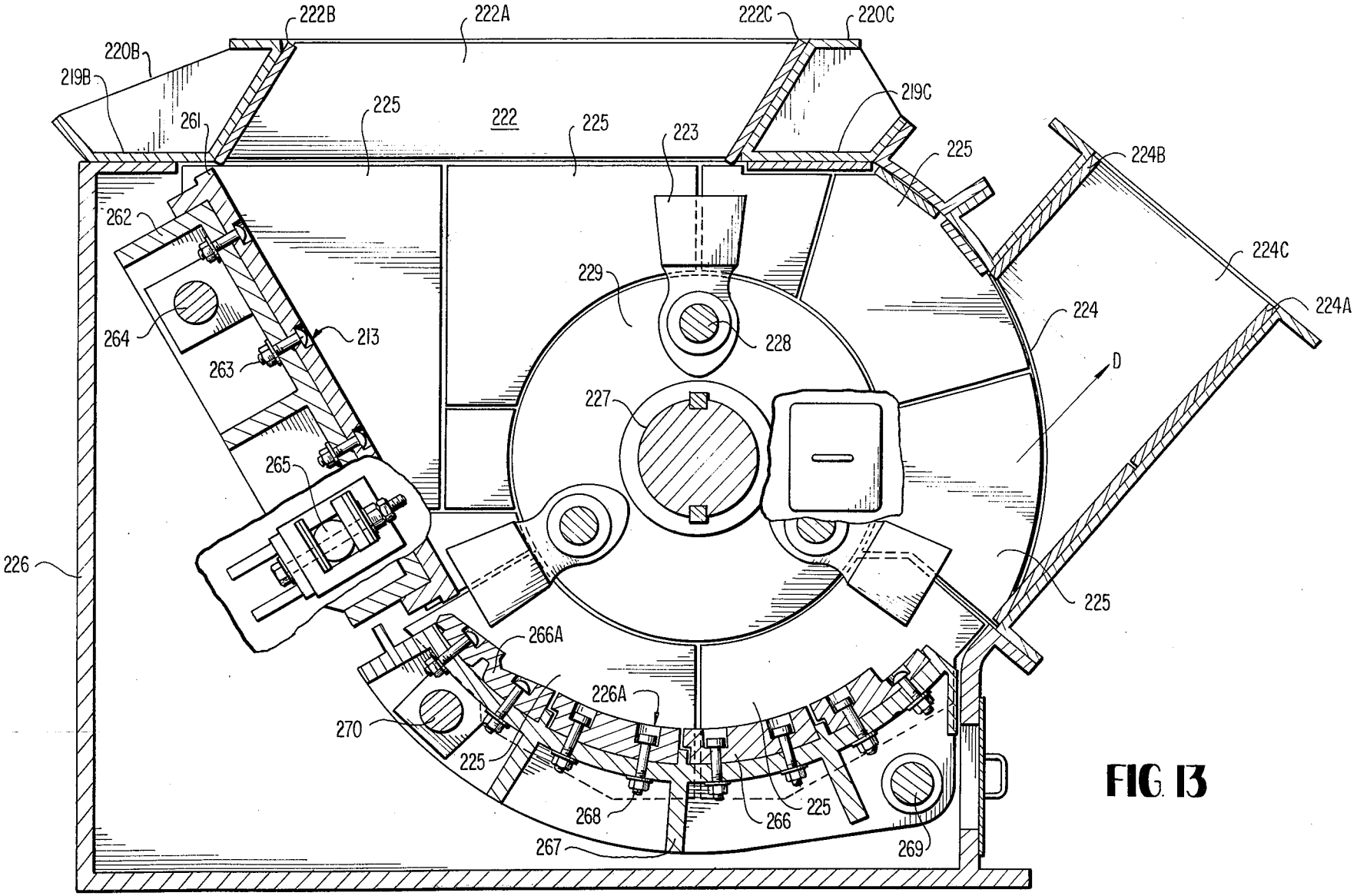
FIG. 13 is a sectional view of a preferred embodiment of the crushing machine of the present invention.
Figure 14:
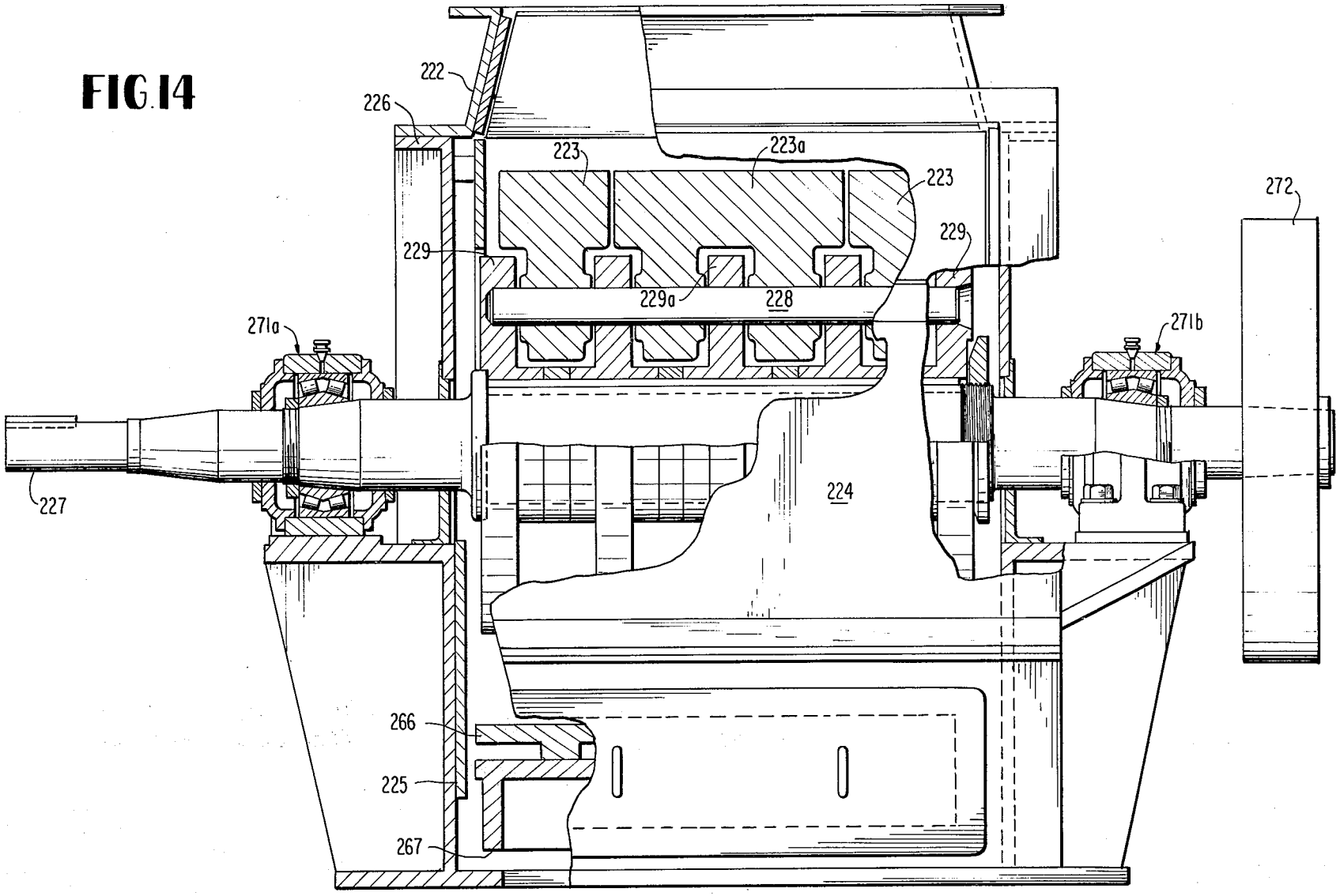
FIG. 14 is a partially broken out end view of the machine of FIG. 13.

The presently preferred configuration of the apparatus shown in FIGS. 13 and 14, has a housing 226 with rotor 227 and flywheel 272 mounted for rotation in suitable bearings **271*a* and 271*b*. Five axially spaced rotor discs 229, carrying three hammer shafts 228, are mounted on shaft 227 for rotation therewith. The hammer shafts 228, mounted at 120° intervals near the peripheries of the rotor discs 229, serve as pivotal mountings for three circles of hammers, including one double width set of two-shank hammers 223*a* in which each hammer has two shanks pivotally connected to a hammer shaft 228 on either side of the center rotor disc 229*a* and includig two circles of single shank outer hammers 223** whose width is approximately equal to the axial center to center spacing of the rotor discs.

The housing 226 includes side panels 225, the feed ramp 213, curved, imperforate impact member 226A, inlet chute 222 and discharge chute 224, along with various other auxiliary equipment.

Inlet chute 22 is of the same width as the portion of the housing in which the hammers rotate, and it is defined by side walls 222A, by downwardly and outwardly inclined end wall 222B and by downwardly and inwardly inclined end wall 222C, as well as end wall supporting structures 220B and 220C which can be bolted to the housing at points 219B and 219C respectively. In the configuration shown, the inlet chute exhibits some tendency to urge incoming material from right to left generally in the direction of the motion of the periphery of the downrunning rotor 227. However, the inlet chute end support members are so shaped that the chute can be unbolted and the positions of the ends reversed, so that the chute will then have a tendency to urge incoming material from left to right, generally in opposition to the direction of rotation of the hammers.

Upon entering the housing, incoming material may first encounter the hammers 223 and 223*a*, or the housing side walls 225, or the feed ramp 213. This feed ramp, has a replaceable wearing surface 261, held in place on a pivotally mounted platen 262 by mounting bolts 263. The platen pivot 264 is a horizontal bar extending between side walls 225 near the upper portion of the housing, spaced radially from the impactor circle. The lower end of the feed ramp is fitted with adjustable securing means 265, securing the lower end of platen 262 either closely adjacent to the impactor circle or at a plurality of positions at further radial spacings therefrom. For protection of the machine, the bar 265 may be of only limited strength so that it will break, allowing the feed ramp to swing down and "unload" the rotor, if the rotor encounters a large object that will not shatter, thus possibly averting self-destruction of the machine.

Imperforate impact member 226A also includes a plurality of replaceable wear surfaces 266, the first of which, 226A, has corrugations formed therein. These wear surfaces are held in place on a curved base 267 by suitable mounting bolts 268. Impactor member 226A is also pivotally mounted on a fixed pivot 270. The cross bar 269 at the right or downstream side of the impact surface 226A can be secured to any suitable adjusting means, not shown, by means of which the right end of the base and associated wear surfaces can be moved radially closer or further from the impactor circle.

The discharge duct 224 has a lower or confining member 224A which comprises an upward, substantially tangential extension of the right side of impact surface 226A, although it is slightly offset therefrom in a radially outward direction. Lower surface 224A, upper surface 224B and side panels 224C define a duct having a completely closed circumference. The orientation of the duct generally corresponds to the trajectory imparted to the material at the downstream end of the inter-reaction zone, generally indicated by arrow D. The direction changing and energy absorbing means has been omitted from this view to permit showing the other parts of the apparatus on the largest scale possible, but it is understood that such means will be generally similar to that shown in the other figures and to that described above.

The following is a summary of parameters of a purely illustrative machine similar to that shown in FIGS. 11 and 12, designed for crushing cement rock. It uses a rotor having a hammer circle of sixty inches, which clears the impact surface by about ½ to 3 inches or more. The hammers are approximately 18 inches long and have a front face to back face width of about 9 inches. The single and double shank hammers have side to side widths of 12 to 24 inches respectively and weigh about 320 and 700 pounds, respectively. The entire rotating mass including hammers, rotor discs, shafts, flywheel and sheaves is about 20,000 pounds, and the machine as a whole weighs less than 100,000 pounds. It appears capable of doing the work of previously known mobile crushers weighing several times as much.

The rotor is designed to turn at about 480 to 700 RPM. The presence of some heavier multi-shank hammers on the rotor makes it possible to get equivalent or better crushing performance at lower rotor speed and therefore lower levels of machine vibration amplitude and creep, as compared to a larger number of single shank hammers of the same total mass, rotating faster. Thus, it could for instance be possible to provide the machine with hammers which extended the full available width of the housing and had three or more shanks.

Uncrushed minerals recovered at the mine face or in a quarry can be quite large, as indicated previously. It is not uncommon for the uncrushed material to include significant quantities, e.g. including 10% or more by weight, of pieces larger than 6 inches across in their smallest dimension, ranging up to so-called "coffin" sized pieces.

Although practical difficulties have arisen in the past in respect to economically conveying such crushed materials to the surface or in crushing them economically and conveniently in the quarry or at the mine face, such difficulties should be reduced by the present invention. The present invention provides crushing apparatus which is simple, easy to load, potentially portable and not dependent on a high supporting frame or trench for discharging to a conveyor. Thus, it is now perfectly feasible to use a modest-width belt conveyor, which is economical compared either to the use of trucks or the use of the other kinds of conveyors previously considered necessary, to transport the crushed output directly from the crushing machine to the surface above or surrounding the mine or quarry. Thus, for instance, in the case of limestone, the crushed product may consist of particles of the order of 6 inches or less in their maximum dimension.

Based on the principles of the invention disclosed herein, those skilled in the art will readily develop other embodiments, all of which are intended to be protected by the appended claims.

What is claimed is:

1. A rotary impact mill for mineral materials such as coal, lignite, ore, stone, rock, oil shale and the like, comprising:

a. a rotor, having pivoted impact hammer means mounted thereon for reducing said mineral materials by impact therewith, the periphery of which defines an impactor circle;

b. a housing rotatably supporting said rotor and having a curved imperforate impact surface which defines the outer perimeter of a rotor-feed material-impact surface inter-reaction zone subtending an arc in said impactor circle which includes the lowest point in said impactor circle and extends upwardly on either side of said point;

c. an inlet duct for said feed material opening into said housing at a point outside said impactor circle above the center of said rotor and on one side of said lowest point, said inlet duct having a width corresponding substantially to the width of the portion of said housing in which said impact hammer means rotate, whereby said impact hammer means strike said feed material as it drops into said impactor circle to reduce said material;

d. an outlet duct for reduced material opening from said housing at a point below said center of said rotor and on the other side of said lowest point, said outlet duct defining a reduced material departure path generally corresponding to the trajectory imparted to said reduced material at the downstream end of said inter-reaction zone and having a lower surface comprising an extension of said imperforate impact surface, said outlet duct being oriented relative to said departure path so as to allow substantially all reduced material impelled from said impact hammer means by said rotor to continue in said trajectory due to the kinetic energy imparted by said impact hammer means; and e. direction changing and energy absorbing means associated with said outlet duct and oriented in said material departure path in a position for receiving at least the larger pieces thrown off by said rotor, for slowing such pieces by absorbing a major portion of said kinetic energy, and for discharging such material from said outlet duct without recycling to said rotor.

2. Apparatus according to claim 1 wherein said impact surface is free of discontinuous components intermeshing with laterally adjacent pairs of impact hammer means.

3. Apparatus according to claim 1 wherein said housing includes an inlet duct which is open to the atmosphere, so that air may be drawn into the housing as the feed material enters, a common flow path through the apparatus being provided for both air and feed up until such point that both have entered said outlet duct.

4. Apparatus according to claim 1 wherein an input conveyor is arranged to deliver feed material to said housing.

5. Apparatus according to claim 1 wherein the outlet duct, upstream of the direction changing and energy absorbing means, is substantially devoid of means impeding the motion of the larger pieces thrown into the duct by the rotor.

6. Apparatus according to claim 1 wherein said direction changing and energy absorbing means is positioned for causing the material which strikes it to descend to a receiver.

7. Apparatus according to claim 1 wherein the discharge outlet is at least partly at an elevation higher than the low point of the impactor circle.

8. Apparatus according to claim 1 wherein said discharge outlet is higher than the axis of rotation of the rotor.

9. Apparatus according to claim 1, including means for rotating said rotor with the periphery of the rotor adjacent the impact surface moving in the direction of said outlet duct and with sufficient force to throw reduced material up the outlet duct and cause it to bounce from said impact surface to a discharge outlet.

10. A method of crushing massive, high density materials such as coal, lignite, ore, stone, rock, oil shale and the like, comprising the steps of:

introducing mineral feed into a housing through an inlet open to the atmosphere;

allowing the mineral feed to drop from said inlet into the impactor circle of a rotor rotating within said housing, said rotor having impact hammer means for reducing said mineral feed by impact therewith, said hammer means defining said impactor circle and said mineral feed dropping into said impactor circle at a location above and to one side of the center of said impactor circle;

impacting said feed material with said rotating impact hammer means as said feed material drops into said impactor circle to crush said material;

causing said reduced material to move into contact with an imperforate impact surface in a rotor-feed material-impact surface inter-reaction zone subtending an arc including and extending upwardly from either side of the lowest point in said impactor circle, to further crush said material;

throwing substantially all material crushed by said rotor and said imperforate impact surface upwardly and outwardly from said rotor on the side of said lowest point opposite to the side on which said mineral feed drops into said impactor circle, along an at least partially confined channel defining a departure path generally corresponding to the trajectory of the material at the downstream end of said inter-reaction zone utilizing the kinetic energy imparted thereto by said rotor, to a level above the axis of rotation of said rotor;

while the crushed material is still in flight, impinging at least the largest pieces thereof against an energy absorbing and direction changing means; and causing the crushed material to descend from said energy absorbing and direction changing means and to discharge from the apparatus without further contact with said rotor.

* * * * *

UNITED STATES PATENT AND TRADEMARK OFFICE

CERTIFICATE OF CORRECTION

PATENT NO. : 3,946,950

DATED : March 30, 1976

INVENTOR(S) : Carl R. Graf

It is certified that error appears in the above-identified patent and that said Letters Patent are hereby corrected as shown below:

Column 9, lines 67 and 68, change "FIGS. 11 and 12" to --FIGS. 13 and 14--

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*